US006930663B2

(12) United States Patent
Sekiya et al.

(10) Patent No.: US 6,930,663 B2
(45) Date of Patent: Aug. 16, 2005

(54) LIQUID CRYSTAL DISPLAY DEVICE

(75) Inventors: Kazuo Sekiya, Tokyo-to (JP); Hajime Nakamura, Yokoham (JP)

(73) Assignee: International Business Machines Corporation, Armonk, NY (US)

( * ) Notice: Subject to any disclaimer, the term of this patent is extended or adjusted under 35 U.S.C. 154(b) by 382 days.

(21) Appl. No.: 10/064,374

(22) Filed: Jul. 8, 2002

(65) Prior Publication Data

US 2003/0006949 A1 Jan. 9, 2003

(30) Foreign Application Priority Data

Jul. 6, 2001 (JP) ..... 2001-207112

(51) Int. Cl.[7] ..... G09G 3/36
(52) U.S. Cl. ..... 345/87; 345/98; 345/99
(58) Field of Search ..... 345/87, 88, 98, 345/99, 204, 690

(56) References Cited

U.S. PATENT DOCUMENTS 6,304,254 B1 * 10/2001 Johnson et al. ..... 345/204

FOREIGN PATENT DOCUMENTS

JP 07-121138 * 5/1995 ..... G09G/3/36

* cited by examiner

*Primary Examiner*—Jimmy H. Nguyen
(74) *Attorney, Agent, or Firm*—Ido Tuchman

(57) ABSTRACT

An overdrive controller for driving a liquid crystal display includes a change rate Rst calculating section for comprehending a transition state from a present brightness to a targeted brightness for each of R, G and B sub-pixels, a select section for selecting the sub-pixel with the slowest transition and the other sub-pixels from the comprehended transition states, and an overdrive voltage calculating section for calculating a voltage to accelerate a transition of brightness for the sub-pixel with the slowest transition. The overdrive controller further includes, an effective brightness Yst' calculating section and Yst' overdrive voltage calculating section for calculating a voltage to accelerate or to decelerate a transition of brightness for the other sub-pixels in order to coordination with each other, wherein the voltage is switched by a switch 23 to be supplied.

9 Claims, 10 Drawing Sheets

| | Target level | level 0 | level 1 | level 2 | level 3 | level 4 | level 5 | level 6 | level 7 | level 8 |
|---|---|---|---|---|---|---|---|---|---|---|
| Static start level | [illegible] | 0.00084 | 0.01030 | 0.04735 | 0.11549 | 0.21812 | 0.35558 | 0.53084 | 0.74584 | 0.99995 |
| level 8 | 5.5530 | 7.9969 | 6.2088 | 5.3833 | 4.7434 | 4.3583 | 4.0163 | 3.7284 | 3.3490 | 1 |
| 1.2V | 5.6836 | 7.9853 | 6.1556 | 5.3011 | 4.6908 | 4.3083 | 3.9580 | 3.6612 | 3.2703 | 1.5190 |
| 1.4V | 5.6605 | 7.9546 | 6.0393 | 5.1766 | 4.5898 | 4.2147 | 3.8688 | 3.5410 | 3.1543 | 1.1244 |
| 1.6V | 5.8939 | 7.8537 | 5.9457 | 4.9601 | 4.4310 | 4.0057 | 3.6906 | 3.3380 | 2.9389 | 1.0166 |
| 2.0V | 7.2035 | 6.9652 | 5.3997 | 4.3980 | 3.8826 | 3.4630 | 3.1309 | 2.7736 | 2.3330 | 0 |
| level 7 | 7.8413 | 6.7816 | 4.9793 | 4.1777 | 3.6770 | 3.2896 | 2.9263 | 2.5656 | 2.168 | 0 |
| level 6 | 8.5975 | 6.3894 | 4.7512 | 3.9271 | 3.4393 | 3.0568 | 2.7401 | 2.385 | 1.9596 | 0 |
| level 5 | 9.1804 | 5.9943 | 4.4898 | 3.7848 | 3.3111 | 2.9200 | 2.579 | 2.2487 | 1.7995 | 0 |
| level 4 | 9.6941 | 5.6087 | 4.3949 | 3.6299 | 3.1811 | 2.782 | 2.4674 | 2.1403 | 1.6869 | 0 |
| level 3 | 10.1912 | 5.7948 | 4.2666 | 3.4791 | 3.023 | 2.7102 | 2.3720 | 2.0355 | 1.5911 | 0 |
| level 2 | 10.7078 | 5.6447 | 4.0978 | 3.346 | 2.8358 | 2.5889 | 2.2742 | 1.9221 | 1.4946 | 0 |
| level 1 | 11.3424 | 5.4003 | 3.907 | 3.2696 | 2.6290 | 2.4518 | 2.1494 | 1.7936 | 1.3155 | 0 |
| level 0 | 12.1062 | 5 | 3.8051 | 3.0622 | 2.6795 | 2.3293 | 1.9869 | 1.6461 | 1.1323 | 0 |

Fig. 7

| Gradation (0 – 8) | Brightness | Response time | Effective brightness i | Effective brightness ii | Effective brightness iii | Effective brightness iv |
|---|---|---|---|---|---|---|
| Level 8→Level 4 | 1.000 → 0.218 | 4 to 5 frame | 0.992 | 0.806 | 0.461 | 0.296 |
| Level 7→Level 0 | 0.746 → 0.001 | 1 to 2 frame | 0.116 | 0.003 | 0.001 | 0.001 |
| Level 7→Level 4 | 0.746 → 0.218 | 3 to 4 frame | 0.545 | 0.328 | 0.253 | 0.229 |

Fig. 9

| | Gradation transition | Linear color mixture i | Linear color mixture ii | Linear color mixture iii | Linear color mixture iv | Color shift i | Color shift ii | Color shift iii |
|---|---|---|---|---|---|---|---|---|
| R | Level 8→Level 4 | 0.805 | 0.609 | 0.414 | 0.218 | 0.992 | 0.806 | 0.461 |
| G | Level 7→Level 0 | 0.559 | 0.373 | 0.187 | 0.001 | 0.116 | 0.003 | 0.001 |
| B | Level 7→Level 4 | 0.614 | 0.482 | 0.350 | 0.218 | 0.545 | 0.328 | 0.253 |
| | White tinged with light pink to deep purple | Almost white tinged with purple | Light purple | Slightly deep purple | Deep purple | Peach | Purplish red | Dark purplish red |

Fig. 10

LIQUID CRYSTAL DISPLAY DEVICE

BACKGROUND OF INVENTION

1. Field of the Invention

The present invention relates to a liquid crystal display device, and more particularly to a liquid crystal display device for improving the problems of response times with regard to a liquid crystal display.

2. Background of the Invention

Recently, a liquid crystal display (LCD) equipped with thin film transistors (TFT) has developed significantly due to its characteristics including light weight, thin shape and low power consumption. Conventionally, the use of LCDs for PCs was mainly directed to displaying static images, however, they have been substituted for CRTs such as when displaying moving pictures in a graphics system or when displaying video images on monitors, so that there is a growing concern about displaying moving pictures using LCDs.

While a CRT is in the impulse type of light emission, an LCD is in the hold type with emitting a continuous light during a whole period of a frame, thus being unable to follow the CRT in terms of a quality of moving pictures if leaving the LCD as it is. Accordingly, there have been proposed a scheme for doubling the refresh rate or the blanking scheme for emitting a light intermittently for each frame in order to obtain the similar characteristics to CRTs for moving pictures. This is an ideal solution but requires a special liquid crystal with a very high speed response, so that the liquid crystals currently in use are not applicable due to their slow response.

For example, a present TN mode TFT-LCD has its on/off response time of about 1 refresh cycle (16.7 ms at 60 Hz refresh), however, the response time delays greatly in a halftone level, resulting in up to a few to ten refreshes. In particular, video images of such as TVs or the like mostly have halftone images, so that correct brightness can not be obtained. Even when displaying text data on PCs, it takes a long time for a screen to become a good condition where one can easily read it when he or she performs a scroll operation.

As above, a deterioration in image quality when displaying moving pictures on a TFT-LCD results from the fact that a transition of brightness of each pixel does not complete within one frame period of 16.7 ms. Namely, even in the case of liquid crystals with a fast response, the capacitance of the liquid crystal changes based on the principle of driving of the liquid crystal, thus the targeted brightness can not be achieved with only one time of charge/discharge of TFT as long as using the normal driving method. Accordingly, the display response is unable to catch up with the image when it changes for each frame. Furthermore, since the response time differs between R(red), G(green) and B(blue) when displaying color images because the response time varies depending on gradations, a remarkable hue variation (color shift) may occur in boundary areas of moving edges or thin lines.

There exists a method called overdrive for resolving the delay of the response time. This method is to improve the response characteristics to a step input for the liquid crystal device by supplying a voltage greater than the targeted voltage at the first frame of input changes in order to accelerate a transition of brightness. For example, Japanese Unexamined Patent Publication No. 1995-12138 discloses a technique where operation timing of a time division light-emitting device of three primary colors (RGB) is delayed by an amount equivalent to the optical response time of the liquid crystal and light is not emitted for a period corresponding to the optical response time in order to implement a color reproduction and further the image signal amplitude is increased to compensate for inadequate writing for halftones.

As described above, for the LCDs with a slow response time, when telop opaque projector) or any daubed area with a sharp boundary is run, some color differing from the original one would be seen on the boundaries depending on the moving speed because the response time for halftones differs between R, G and B sub-pixels, thereby causing a color shift. Even if tolerating the boundary areas blurring due to the slow speed of gradation changes, the color on the boundary area ought to be a mixture of the previous and subsequent colors of that boundary. However, another hue differing from the essential color mixture might occur when the response time differs between R, G and B. A range where this color shift occurs would extend from the boundary to a point which will be reached for one frame period with the moving speed if the difference of response times between R, G and B sub-pixels for the gradation change settles within one frame period. However, if it takes n frame periods for settlement, the color shift would occur for n times of the number of pixels.

The overdrive technique allows matching the response time of each sub-pixel to about one frame period, however, it can not accelerate a transition to a full OFF state, i.e., 0V. When not allowed using a voltage which exceeds the voltage used for statically defined gradations (i.e., overvoltage range), there may occur a case where it is impossible to respond within one frame period in the on-direction transition. Furthermore, particularly seen in the TN mode liquid crystals, the effective brightness (average brightness) can not be matched within one frame period even by using the overdrive technique because the response time changes depending in particular on the starting gradation and targeted gradation.

SUMMARY OF INVENTION

In view of the above technical problems, a feature of the present invention is to suppress color shifts which may occur when any area with a sharp boundary moves and to improve an abnormal appearance of colors at the moving boundary areas.

In view of the above purposes, although it is essentially preferable to perform overdrive, the present invention is characterized in that it considers the difference of the change rate of effective brightness between R, G and B sub-pixels in case that the acceleration to 0V is impossible or some transition is unable to be accelerated because of the unusable overdrive range such as the above 5V range, etc., and adjusts the degree of overdrive for the other two sub-pixels to coordinate with the one exhibiting the slowest effective brightness. Namely, a liquid crystal display device of the present invention includes a liquid crystal cell forming an image display area, a driver for applying a voltage to the liquid crystal cell, and an overdrive controller for controlling the driver to apply an overdrive voltage exceeding a targeted pixel value to the liquid crystal cell. The overdrive controller controls such that the driver outputs the voltage which is accelerated or decelerated (i.e., overdriven or underdriven) to coordinate effective brightness of each sub-pixel which forms a single full-pixel with each other.

In another aspect of the present invention, a liquid crystal display device of the invention includes a liquid crystal cell for displaying an image when a voltage is applied to each pixel in a TFT structure, a driver for applying a voltage to each of the pixels of the liquid crystal cell, and a controller for controlling the driver to apply a voltage to the liquid crystal cell. The voltage exceeds what is to be applied when displaying targeted brightness on the liquid crystal cell. The controller includes transition state comprehending unit for comprehending for each of the sub-pixels a transition state between present starting brightness of the liquid crystal cell predicted in advance and targeted brightness at one refresh cycle later which is to be displayed hereupon, and voltage calculating unit for calculating a voltage to be applied to each of the sub-pixels based on the transition state comprehended.

In a further aspect of the present invention, there is provided a liquid crystal display drive circuit provided in, for example, a liquid crystal display device or host device. This drive circuit includes transition state comprehending means for comprehending a transition state from present brightness to targeted brightness for each sub-pixel, select means for selecting the sub-pixel exhibiting the slowest transition and the other sub-pixels from the comprehended transition states, acceleration voltage calculating means for calculating a voltage to accelerate a transition of brightness for the sub-pixel with the slowest transition, and acceleration/deceleration voltage calculating means for calculating a voltage to accelerate or to decelerate a transition of brightness for the other sub-pixels in order to coordinate with each other.

Another liquid crystal display drive circuit of the invention includes a capacitance predicting unit for predicting a capacitance value that each pixel will reach at one refresh cycle later when applying a predetermined voltage for targeted brightness, a storage device for storing the predicted capacitance value, a transition state comprehending unit for comprehending a transition state of brightness based on the targeted brightness of each sub-pixel at one refresh cycle later and the capacitance value stored in the storage device, and a voltage calculating means for calculating a voltage to be applied to each sub-pixel based on the transition state of brightness comprehended.

In a yet further aspect of the present invention, there is provided a method for driving a liquid crystal display, wherein an input pixel value is overdriven to output a modified pixel value, the method includes the steps of: predicting a capacitance value that each pixel will reach at one refresh cycle later when applying a predetermined voltage for the input pixel value; storing the predicted capacitance value; comprehending a transition state of brightness for each of sub-pixels constituting each pixel based on an input pixel value at one refresh cycle later and the stored capacitance value; and calculating a voltage for a predetermined sub-pixel to be underdriven depending on the transition state of brightness comprehended.

Another method for driving a liquid crystal display of the invention includes the steps of: comprehending effective brightness of each of R, G and B sub-pixels in a transitional frame based on targeted brightness of each of the sub-pixels; coordinating effective brightness of each of the sub-pixels with each other based on the effective brightness comprehended in the transitional frame until the targeted brightness; and controlling a transitional color to be a mixed color lying on a linear interpolation curve between a previous and subsequent colors of a boundary.

In a further aspect of the present invention, there is provided a program for directing a computer to perform the method steps described above. This program may be, for example, transferred from a remote program transmission apparatus via a network to a computer in which the present invention is implemented. Alternatively, the program may be provided to a computer via storage media such as a CD-ROM. Such storage media need only to be able to read a reader device (e.g., CD-ROM drive) provided in a computer.

Various other objects, features, and attendant advantages of the present invention will become more fully appreciated as the same becomes better understood when considered in conjunction with the accompanying drawings, in which like reference characters designate the same or similar parts throughout the several views.

BRIEF DESCRIPTION OF DRAWINGS

FIG. 7 is a table stored in the overdrive voltage calculating section and used to obtain an overdrive voltage to be applied this time from the present capacitance value.

FIG. 9 is a table showing the values read from FIG. 8.

FIG. 10 is a table showing color transitions based on gradation transitions shown in FIG. 9.

DETAILED DESCRIPTION

Moreover, a controller of the present invention further includes a capacitance predicting unit for predicting a capacitance value of a pixel that will be reached after the refresh cycle when applying the voltage calculated by the voltage calculating unit to the pixel with the present capacitance value; and a storage device for storing the capacitance value predicted by the capacitance predicting unit.

Now the present invention will be described with reference to the accompanying drawings.

Figure 1:
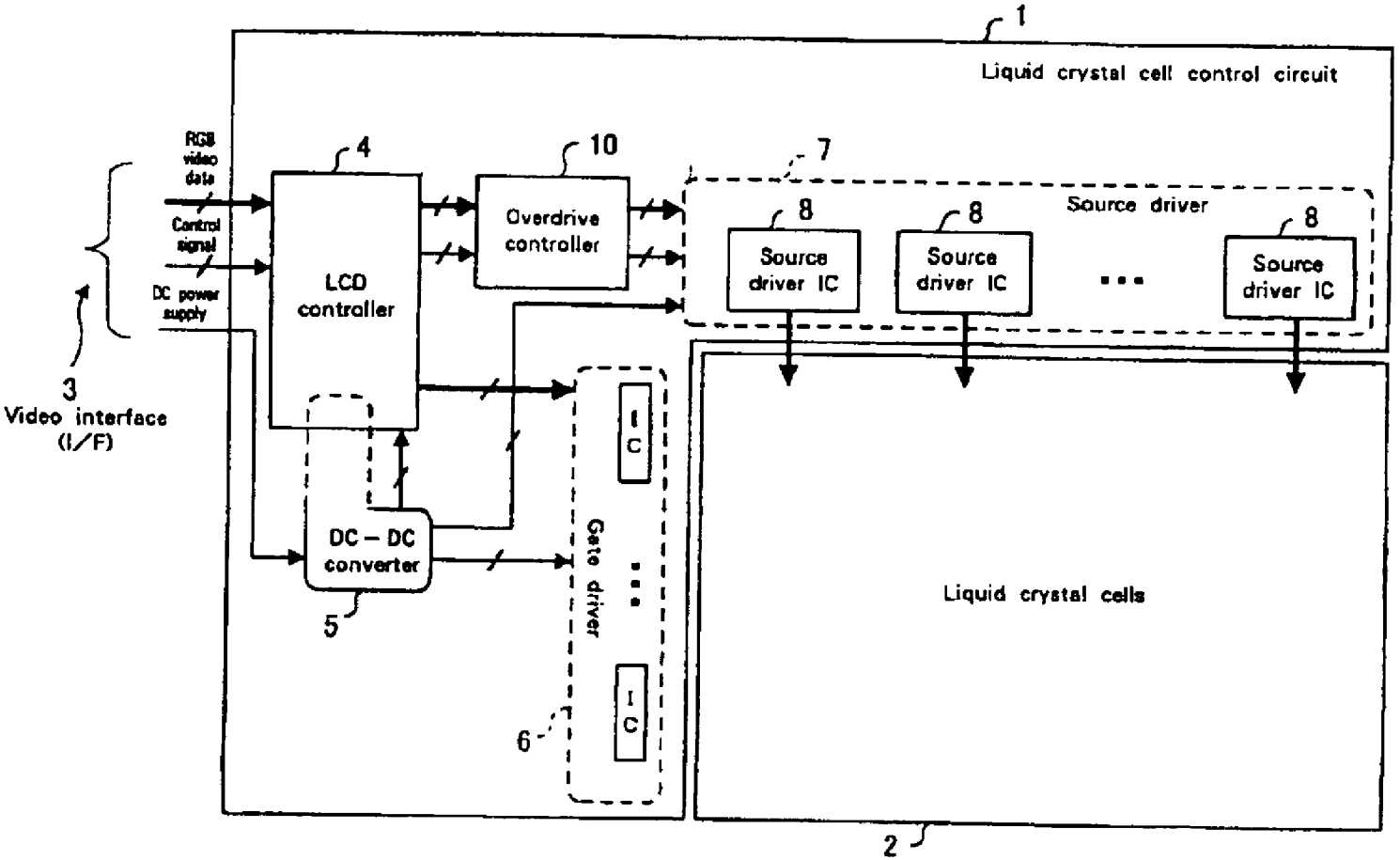
FIG. 1 is a schematic diagram of an embodiment of a liquid crystal display (LCD) device according to the present invention.

FIG. 1 is a schematic diagram of an embodiment of a liquid crystal display (LCD) device according to the present invention. As for the LCD device shown in FIG. 1, a liquid crystal module (LCD panel) is composed of a liquid crystal cell control circuit 1 and a liquid crystal cell 2 with a liquid crystal structure of thin film transistors (TFT). The liquid crystal module is formed in a display device separated from a system unit on the host's side such as a personal computer (PC) and video signal receiver or in the display part of a notebook computer or combination TV integral with display. Namely, LCD device may be a standalone type of LCD connected to a host system via a line or an integral type comprising both a host system and LCD. In a liquid crystal cell control circuit 1 shown in FIG. 1, RGB video data (i.e., video signals), control signals and DC power supply are input to an LCD controller 4 via a video interface (I/F) 3 from a graphics controller LSI (not shown) in the system. LC cell 2 may be a TFT liquid crystal of TN (twisted nematic) mode, for example.

DC-DC converter 5 generates a variety of DC power supply voltages necessary for liquid crystal cell control circuit 1 from DC power supply being supplied, and supplies them to a gate driver 6, a source driver 7 and a fluorescent tube (not shown) for backlight, etc. LCD controller 4 processes signals received from video I/F 3 and supplies processed signals to gate driver 6 and source driver 7. There exists an overdrive controller 10 between LCD controller 4 and source driver 7. Source driver 7 is responsible to supply a voltage to each of the source electrodes of TFTs arranged in a horizontal direction (X direction) in a TFT array, which is arranged in a matrix fashion on liquid crystal cells 2. Gate driver 6 is responsible to supply a voltage to each of the gate electrodes arranged in a vertical direction (Y direction) in a TFT array. Both gate driver 6 and source driver 7 are comprised of multiple ICs, wherein source driver 7 includes multiple source driver ICs 8 made of LSI chips, for example.

The withstand voltage of source driver 7 is typically 5V in TN mode for a notebook PC, wherein a 64 gradation (6 bit) driver is used in notebook PCs without FRC (frame rate control). On the other hand, an LCD monitor typically employs an IPS (in-plane switching, i.e., lateral electric field) mode, wherein a 256 gradation (8 bit) driver with a withstand voltage of about 15V is used, however, substantially half that voltage, i.e., about 7.5V is used by utilizing a dot inversion driving scheme. Source driver 7 for IPS can be used for TN liquid crystal (hereinafter TN-LC), wherein a higher voltage than 5V can be used for overdrive. It is noted that with respect to FRC (frame rate control), ±1 bit may be appended to the least significant bit over four frames in order to represent 8 bit gradation using 6 bit driving, wherein the low order two bits are used for time modulation. It is also noted that since FRC assumes that a PC screen is static, another color may be appear when scrolling a thin line continuously, for example. It is undesirable to perform FRC for moving portions because the number of gradation levels may be sacrificed.

A TFT-LCD constituting LC cell 2 has a response time slower than the display device such as a CRT. Note that a "response time" is defined as time required to reach the absolute brightness precision (one-half or one-quarter of the gradation interval considering gamma characteristics) corresponding to a targeted gradation. The cause of slow response time includes a problem of the cumulative response and a problem resulting from that a liquid crystal is a viscous fluid, etc. The cumulative response is explained as follows: a targeted gradation is not reached only by a single charge and discharge so that it is gradually approximated as a result of accumulation of a voltage applied over multiple frames. Concerning the problem of viscous fluid, in a TN mode, for example, since liquid crystal molecules disturb in three dimensions in terms of both degrees of freedom θ and Ø upon transition, the transition of brightness, which is influenced both by θ and Ø, delays compared to that of capacitance which represents an average value state of θ. Therefore, a liquid crystal itself is considered to have a slow displacement speed.

In view of these problems, the present invention attempts to reach the targeted brightness at the end of one frame period by applying an overdrive voltage to accelerate the transition of brightness. For example, there exists an overdrive controller 10 in a stream of pixel values from LCD controller 4, which passes to source driver 7 the pixel values overdriven to be modified. The term "overdrive" means here that an excessive voltage exceeding a targeted voltage is applied for a starting gradation in contrast to a voltage to be applied when displaying the targeted gradation, wherein the applied voltage may be excessive on a pulse (+) direction or may be excessive on a minus (−) direction (i.e., towards 0 V).

Figure 2:
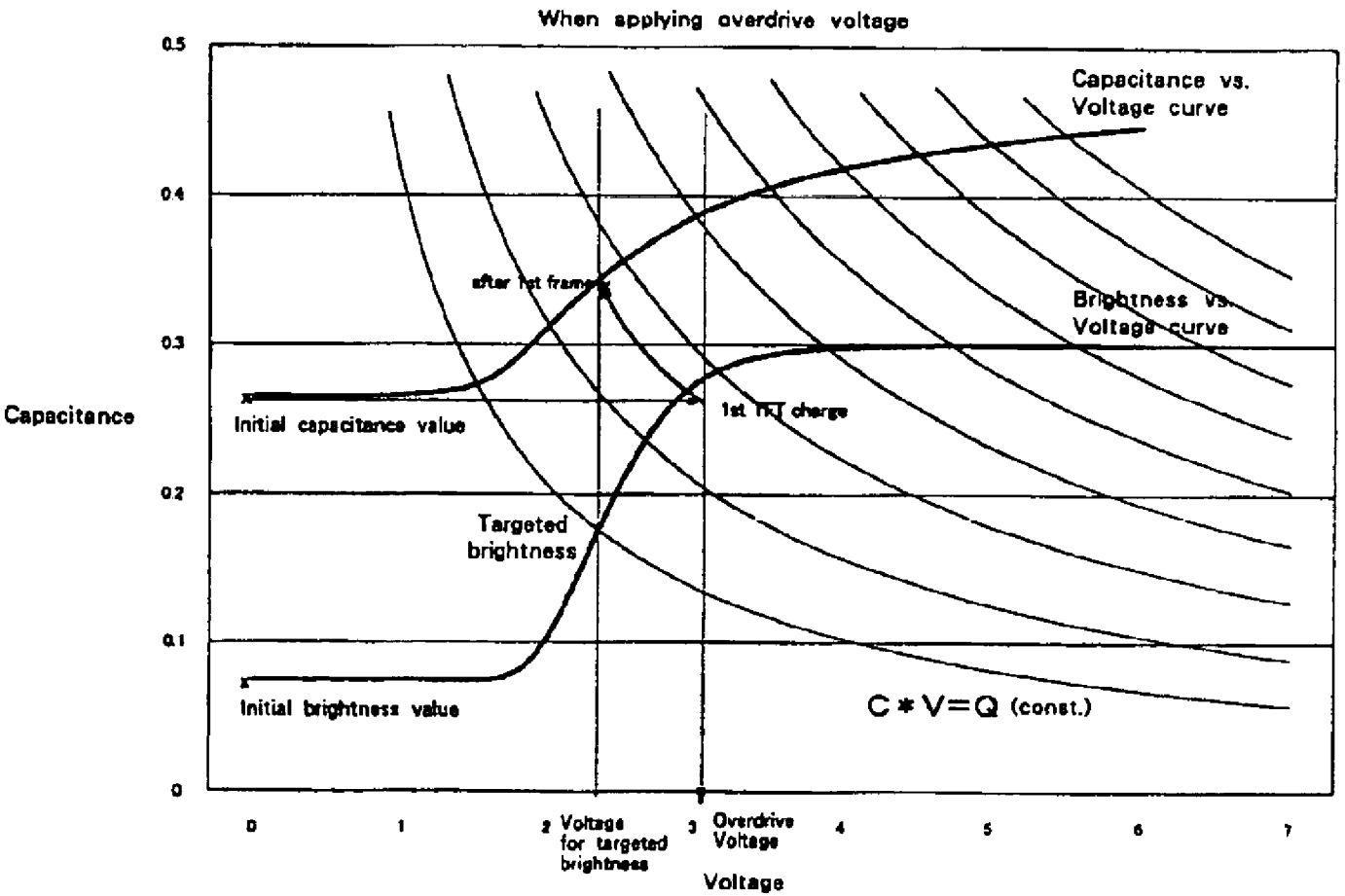
FIG. 2 is a diagram illustrating the characteristics of a liquid crystal when applying an overdrive voltage.

FIG. 2 is a diagram illustrating the characteristics of a liquid crystal when applying an overdrive voltage. A horizontal axis represents a voltage and a vertical axis represents capacitance, wherein a brightness vs. voltage curve and a capacitance vs. voltage curve are depicted. In the drawing, there is shown the case where the excessive voltage is applied on the plus direction. Starting with an initial capacitance value, then applying an overdrive voltage by adding an excessive voltage to the one corresponding to the targeted brightness, the capacitance reaches the targeted position on the capacitance vs. voltage curve, with moving along the inverse proportional line of $C \cdot V = Q$ (Q is constant). As a result, the brightness reaches the targeted brightness on the brightness vs. voltage curve from its initial value. It should be noted that the overdrive voltage depends on the state of a pixel liquid crystal at a staring point.

In order to implement the overdrive with high precision, it may be necessary to select source driver 7 with a greater number of gradation levels than at present or to use a different voltage than at present in source driver 7. One can consider that a pixel value being input to overdrive controller 10 is a brightness value, on which gamma correction has already been performed. Alternatively, the input value may be an index value representing a gradation rather than the brightness value itself. The output pixel value is a voltage value to be applied to each pixel. If source driver 7 is a digital input type, the output value may be a value indicating a voltage.

Since brightness sensitivity of human beings at less than 80 ms is considered to be an integrated value in terms of time (see Bloch's law "Sense and Perception Handbook"), according to the present invention, it is defined as effective brightness what is obtained by integrating brightness at a moment for one frame period, considering time is a refresh cycle unit. For covering all kinds of display contents such as for a PC display including one dot width line, the effective brightness can not be achieved without a delay of one frame period for display. Namely, unless there is known not only a gradation change from a previous frame to a present frame but also a gradation change from the present frame to a next frame, an integrated value of brightness can not be obtained for a luminescent spot of one dot appearing before and after the refresh timing. Accordingly, in order to match the effective brightness to the targeted brightness, two-stage frame buffers are necessary to display an image with one frame period delay.

When accepting one frame delay, it may be possible to overdrive either excessively or sparingly in order to match the effective brightness to the targeted brightness (accurately speaking, the targeted brightness at one frame period later). However, one frame delay is undesirable for moving pictures and may lead to cost increase.

On the other hand, when one frame delay is not allowed, the effective brightness must be adjusted within the present frame. However, when matching the effective brightness to the targeted brightness in the present frame, the excessive integration of brightness would remain in a next frame unless a gradation transition is performed in no time. Namely, one must give up an attempt to match the effective brightness to the targeted brightness when one frame delay is not allowed.

Figure 3:
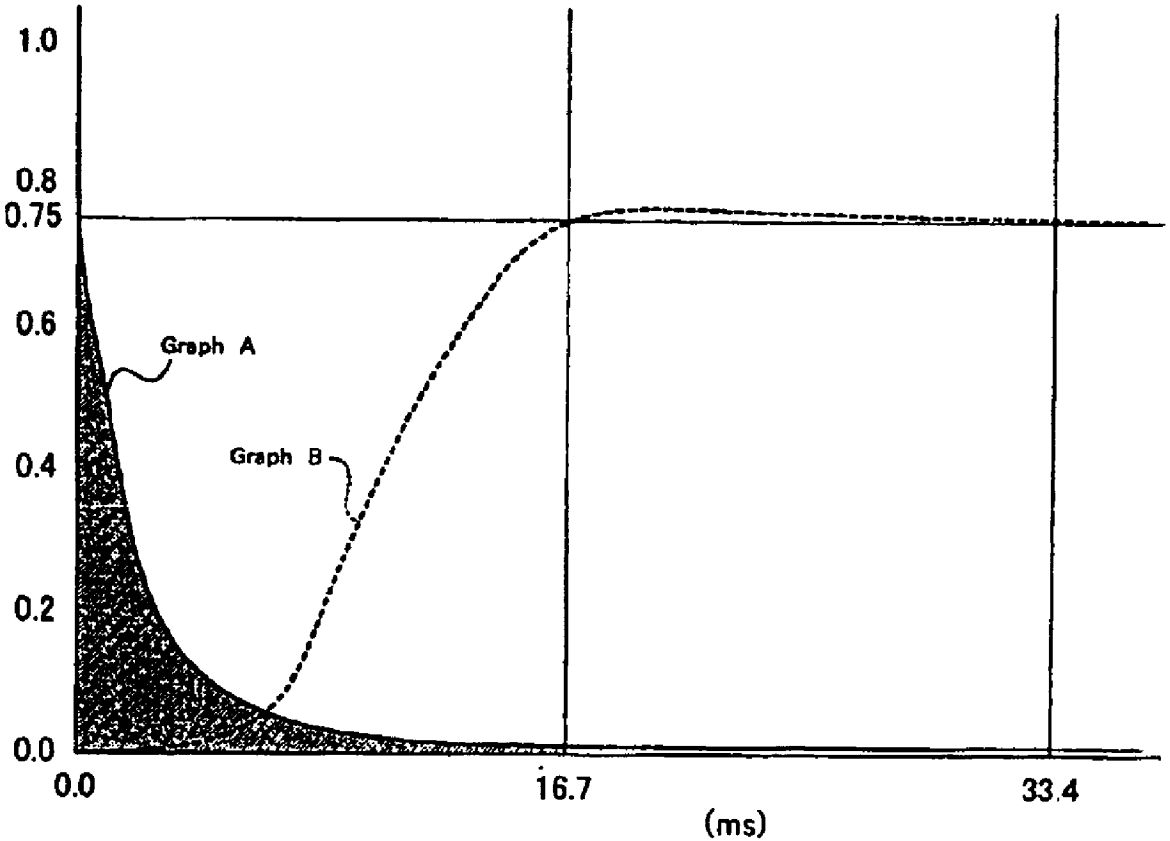
FIG. 3 depicts an example transition of brightness for overdrive.

FIG. 3 depicts an example transition of brightness for overdrive. A horizontal axis represents time (ms) for transition and a vertical axis represents a brightness level. Concerning the overdrive, a targeted brightness can be reached in an appropriate condition by controlling such that an instantaneous brightness reaches the targeted brightness at the end of a frame. However, the effective brightness in a flame in which a transition occurs varies significantly depending on a starting gradation and a targeted gradation. For example, in FIG. 3, comparing a transition (graph A shown by solid line) from brightness 0.75 (level 7) to brightness 0.0 (level 0) with an opposite transition (graph B shown by dotted line), the effective brightness for this frame (i.e., area of shaded portion) is about 1/16.7 and 4/16.7, respectively, thus does not match in spite of the fact that the transitional gradation difference is both the same. In this way, since the transition of brightness curve of the liquid crystal depends significantly on a starting gradation and a targeted gradation, the effective brightness obtained by integration for one frame period (16.7 ms) may vary even when a targeted brightness is reached within one frame period.

When an effective brightness of a transitional frame does not match a targeted brightness, a moving boundary would more or less blur. Considering integration of brightness along a sight line pursuit path, which can represent a blur successfully for a hold type of display devices such as LCDs, the blur at a boundary is represented by a mixed color lying on a linear interpolation curve between a previous and subsequent colors of the boundary. However, when a difference (nonlinear difference) occurs between R, G and B in a transitional frame as described above, the resulting color swerves from the mixed color on the linear interpolation curve between the previous and subsequent colors of the boundary, thereby generating a hue variation (color shift). If a moving object has a width of only one pixel, it would not be so remarkable, however, when some region daubed by the same color moves, a region with a correct color would follow a portion where the color shift occurs, whereby the color shift would be easily perceived at the boundary area as an abnormal color.

Furthermore, even if the overdrive is performed, it is impossible to accelerate a transition to a full OFF state (0 V). Alternatively, when not allowed using an overvoltage range, there may occur a case where it takes several frame periods to reach a targeted brightness in the on-direction transition due to the cumulative response effect. If it takes n frame periods for settlement, the color shift would occur for n times of the number of pixels corresponding to the moving speed. It should be noted that for an LCD which does not use the overdrive scheme, the difference of response times may reach about six frames, i.e., 0.1 ms, thus resulting in a severe color shift.

In view of the above, according to the present invention, the response time of sub-pixels is accelerated or decelerated using the same scheme as the overdrive in order to coordinate R, G and B effective brightness in a full-pixel in each frame until the targeted brightness is reached. This allows controlling a transitional color to be a mixed color lying on a linear interpolation curve between a previous and subsequent colors of a boundary, thereby avoiding color shifts while the blur might occur.

The method of the present invention is insistently based on the overdrive. When R, G and B sub-pixels all reach the targeted brightness, the essential overdrive is performed regardless of the change rate of transition Rst. Though it is conceivable to perform underdrive in order to coordinate the effective brightness in one frame even when R, G and B all reaches the targeted brightness within one frame period, this would result in that the sub-pixel having reached the targeted brightness and the other sub-pixel having not reached yet are mixed in a subsequent frame, which is undesirable in terms of appearance. It is also conceivable in the subsequent frame to intentionally vary the brightness of the sub-pixel having reached the targeted brightness in order to match to the effective brightness of the one having not reached yet, however, in general it is undesirable to prolong the variation.

The method of the invention never performs excessive overdrive where the brightness at one frame later exceeds the targeted brightness. Moreover, the method comprises the steps of: among R, G and B sub-pixels in a full-pixel, selecting the one whose transition of the effective brightness is slowest in changing from the present brightness to the targeted brightness; and on the assumption that the previous and subsequent colors of the boundary are mixed linearly, underdriving the other sub-pixels such that the effective brightness of them lie on the linear interpolation curve. It should be noted that underdrive means here applying a less difference voltage as opposed to overdrive. The underdrive voltage is to be a voltage which decelerate the transition of brightness from the present brightness to the targeted brightness.

Figure 4:
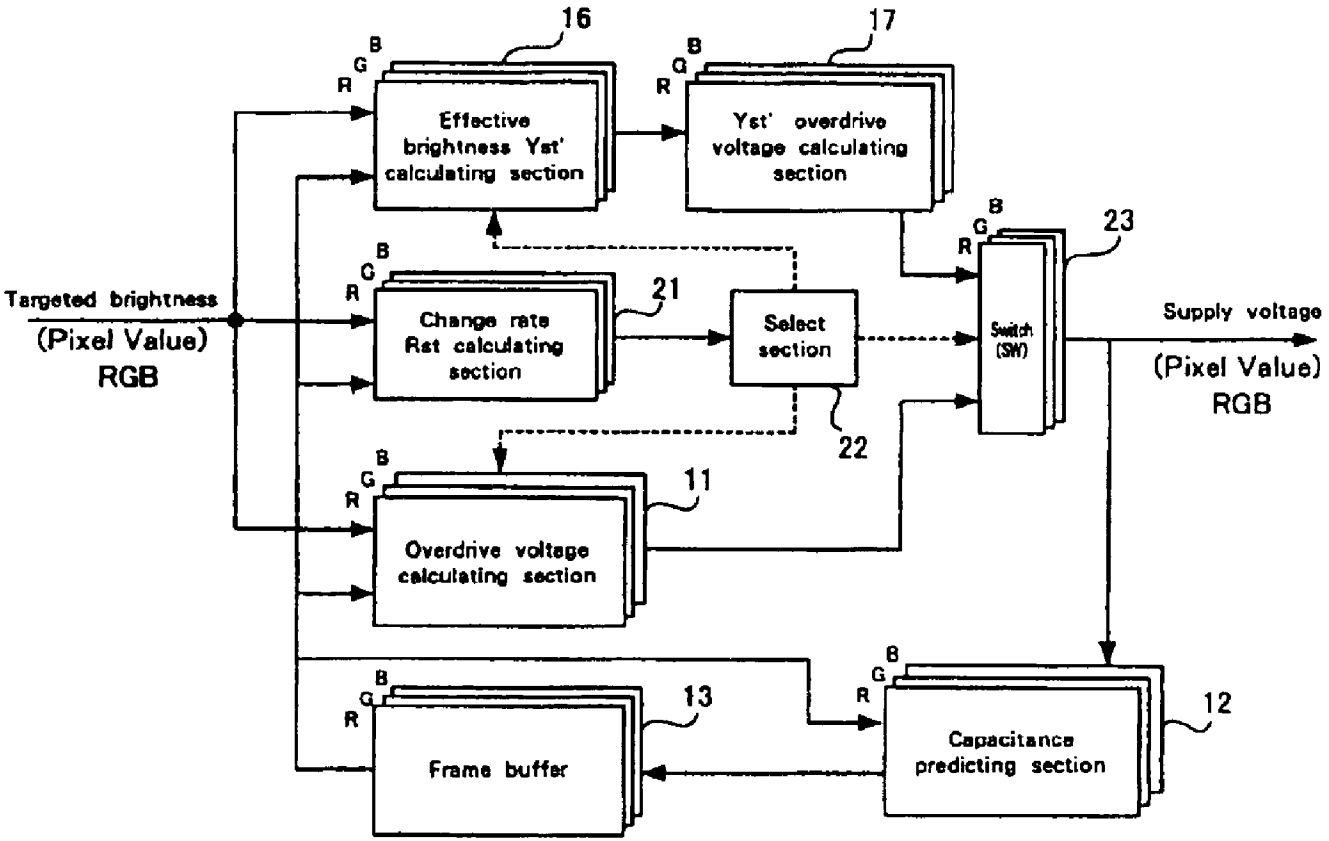
FIG. 4 is a diagram illustrating a configuration of an overdrive controller according to the invention.

FIG. 4 is a diagram illustrating a configuration of overdrive controller 10 according to the invention. It comprises an overdrive voltage calculating section 11 for calculating an overdrive voltage to be applied to a pixel this time based on targeted brightness and a present capacitance value; capacitance predicting section 12 for predicting a capacitance value at one frame period later; and a frame buffer 13 for storing the capacitance value at one frame period later predicted by capacitance predicting section 12.

Overdrive controller 10 further comprises an effective brightness Yst' calculating section 16 for calculating an effective brightness Yst' which is accelerated or decelerated for coordination, and a Yst' overdrive voltage calculating section 17 for calculating an overdrive voltage for the calculated effective brightness Yst'. It should be noted that "coordination" means here coordinating the variation of the effective brightness of each of the sub-pixels. Further provided in overdrive controller 10 are a change rate Rst calculating section 21 for calculating a change rate Rst of R, G and B based on the input targeted brightness, and a select section 22 for selecting the sub-pixel with the slowest change rate RstMin and notifying the overdrive voltage calculating section 11 as well as notifying the effective brightness Yst' calculating section 16 of information about the other sub-pixels, and a switch (SW) 23 for switching the overdrive voltage calculated by overdrive voltage calculating section 11 and Yst' overdrive voltage calculating section 17 according to the selected information from select section 22.

Figure 5:
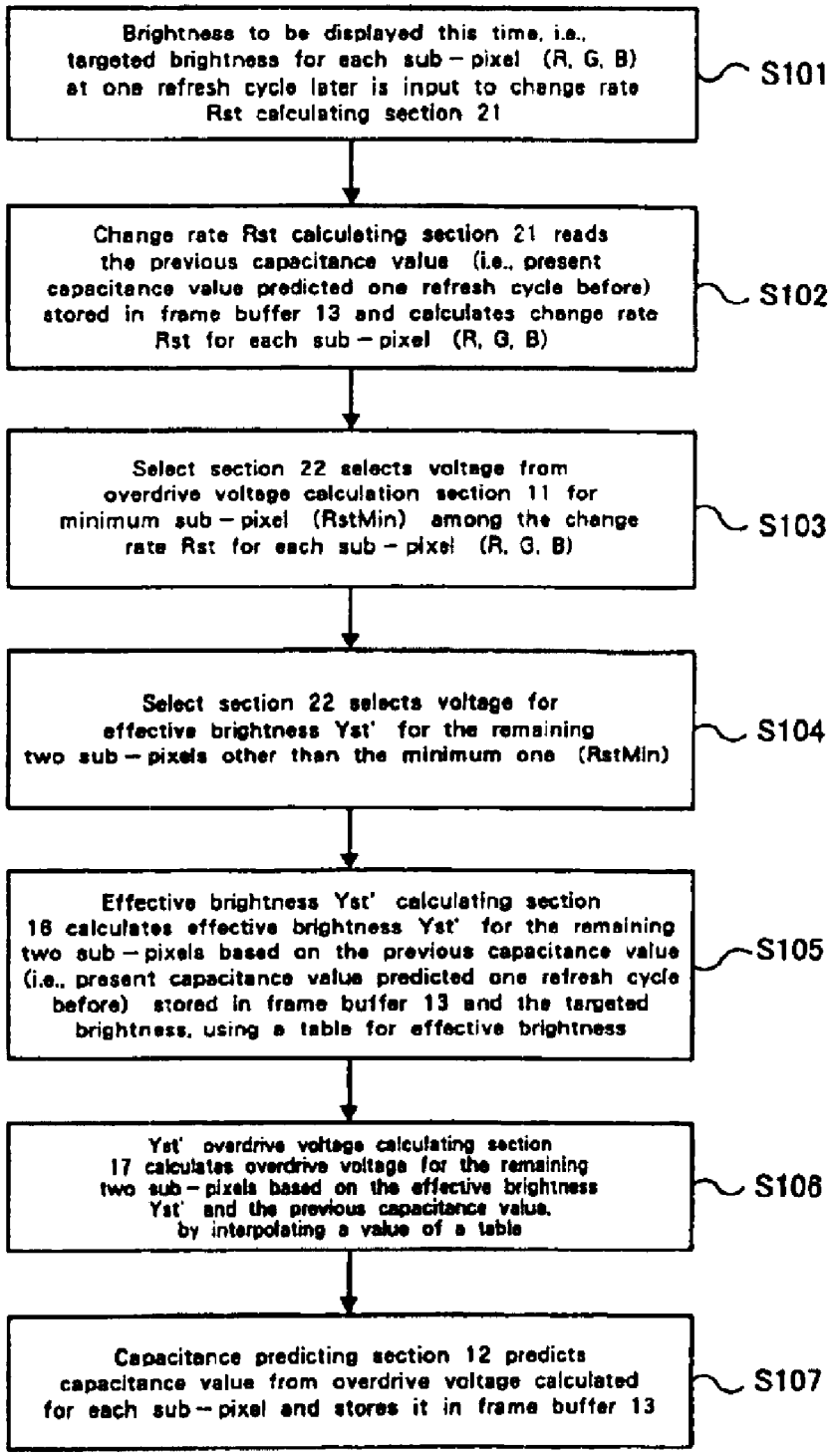
FIG. 5 is a flowchart illustrating the overdrive processing according to the present invention.

FIG. 5 is a flowchart illustrating the overdrive processing according to the present invention. First, the brightness to be displayed this time, that is, the targeted brightness for each sub-pixel (R, G, B) at one refresh cycle later is input to change Rst calculating section 21 (step 101). Then, change rate Rst calculating section 21 reads the previous capacitance value (i.e., present capacitance value predicted one refresh cycle before) stored in frame buffer 13 and then calculates the change rate Rst for each sub-pixel (R, G, B) (step 102). Select section 22 selects a voltage from overdrive voltage calculating section 11 for a minimum sub-pixel (RstMin) among the change rate Rst for each sub-pixel (R, G, B) (step 103). Select section 22 also selects a voltage for the effective brightness Yst' for the remaining two sub-pixels other than the minimum one (RstMin) (step 104).

Effective brightness Yst' calculating section 16 calculates the effective brightness Yst' by interpolating for the remaining two sub-pixels other than the minimum one (RstMin) based on the previous capacitance value (i.e., present capacitance value predicted one refresh cycle before) stored in frame buffer 13 and the targeted brightness, using a table for effective brightness provided in itself (step 105). Then, Yst' overdrive voltage calculating section 17 calculates an overdrive voltage for the remaining two sub-pixels other than the minimum one (RstMin) based on the effective brightness Yst' and the previous capacitance value, by interpolating a value of a table provided in itself (step 106). Then, capacitance predicting section 12 predicts a capacitance value from the overdrive voltage calculated for each of the sub-pixels and stores it in frame buffer 13 (step 107).

Figure 6:
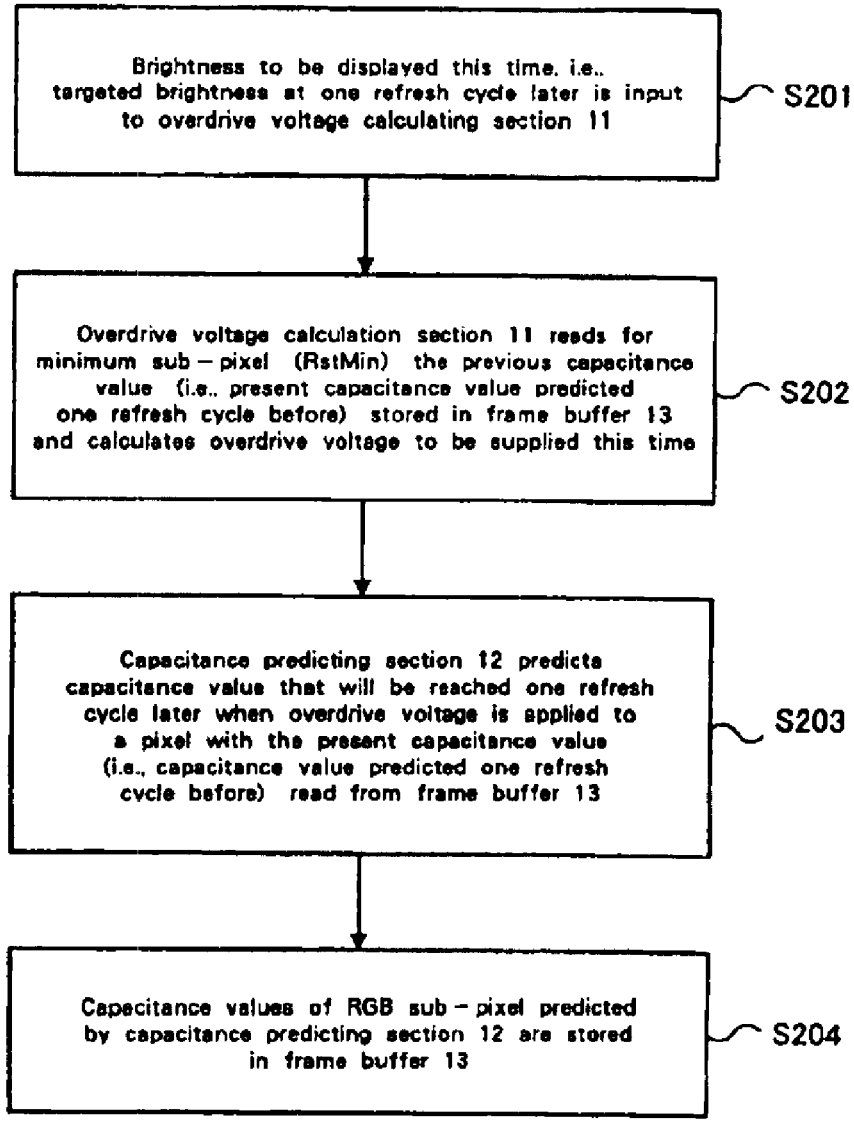
FIG. 6 is a flowchart illustrating the overdrive processing performed on the minimum one (RstMin) among the change rates Rst for sub-pixels (R, G, B).

FIG. 6 is a flowchart illustrating the overdrive processing performed on the minimum one (RstMin) among the change rates Rst for sub-pixels (R, G, B). First, the brightness to be displayed this time, that is, the targeted brightness at one refresh cycle later is input to overdrive voltage calculating section 11 (step 201). Overdrive voltage calculating section 11 reads for the minimum sub-pixel (RstMin) the previous capacitance value (i.e., present capacitance value predicted one refresh cycle before) stored in frame buffer 13 and then calculates an overdrive voltage to be supplied this time (step 202). Capacitance predicting section 12 predicts, for each sub-pixel selected by switch 23, a capacitance value that will be reached one refresh cycle later when the overdrive voltage is applied to a pixel with the present capacitance value (i.e., capacitance value predicted one refresh cycle before) which is read from frame buffer 13 (step 203). Namely, prediction of the capacitance value is performed for each of the sub-pixels R, G and B. The capacitance values predicted by capacitance predicting section 12 are stored in frame buffer 13 (step 204). The capacitance values stored in frame buffer 13 are used by overdrive voltage calculating section 11 and capacitance predicting section 12 as a capacitance value of the present pixel at one refresh cycle later, as well as are used by change rate Rst calculating section 21 and effective brightness Yst' calculating section 16.

In this manner, the voltage for each of the sub-pixels R, G and B output from switch (SW) 23 is input to capacitance predicting section 12, whereas the capacitance value predicted by capacitance predicting section 12 is stored in frame buffer 13 as described above. Therefore, it is characterized in that what is stored in frame buffer 13 is not the predicted voltage or brightness but the predicted capacitance. As described before, the capacitance value stored in frame buffer 13 is used by overdrive voltage calculating section 11 to calculate the overdrive voltage as well as is input to change rate Rst calculating section 21 and effective brightness Yst' calculating section 16 to calculate the change rate Rst and the effective brightness Yst'. In this manner, according to the present invention, the transition state, i.e., change rate Rst, of brightness is comprehended for each of the sub-pixels R, G and B between the targeted brightness at one refresh cycle later, which is to be the pixel value to be displayed to the liquid crystal cell this time, and the present starting brightness predicted in advance. Then, based on the transition state comprehended, select section 22 selects either overdrive voltage calculating section 11 or Yst' overdrive voltage calculating section 17 for each of the sub-pixels to calculate a voltage to be applied.

Now assuming that the effective brightness (i.e., average brightness for a frame) is Yst when overdrive is performed with the starting brightness S and targeted brightness T. In this case, the change rate Rst for a transition between S and T, which is calculated by change rate Rst calculating section 21, will be the following:

$$Rst=(Yst-S)/(T-S)$$

where Rst≧0. It should be noted that the operation for selecting the slowest transition among R, G and B in select section 22 corresponds to selecting the smallest Rst. It is assumed here that the selected Rst is termed RstMin.

In order to accelerate or decelerate the remaining two sub-pixels, the effective brightness Yst' is obtained for each using effective brightness Yst' calculating section 16 as follows:

$$Yst'=S+(T-S)\times RstMin$$

Then, a voltage for implementing the effective brightness (average brightness) Yst with starting brightness S is selected using Yst' overdrive voltage calculating section 17. It should be noted that the voltage for implementing Yst' may be an underdrive voltage rather than an overdrive voltage. Furthermore, though the starting capacitance should be used as a starting parameter, for simplicity of explanation, the starting brightness S is used here. However, for much more improving the precision, both may be used as the starting parameters.

Moreover, overdrive voltage calculating section 11 stores values for calculating an overdrive voltage to be applied this time based on the present capacitance value, wherein these values are obtained from the simulation and used as reference data for interpolation. On the other hand, capacitance predicting section 12 stores information for calculating a capacitance value at one frame period later for a pixel with a certain capacitance value. More specifically, it predicts, for example, what capacitance value a pixel will reach after 16.7 ms when applying a given voltage to the pixel with a certain capacitance for a gate selection time (herein 21.7 $\mu$s for simulation, for example). It should be noted that those values stored in the overdrive voltage calculating section 11 and capacitance predicting section 12 are unique parameters to an LCD used.

FIG. 7 is a table stored in the overdrive voltage calculating section 11 and used to obtain an overdrive voltage to be applied this time from the present capacitance value. This table is based on the inventors' simulation associated with a TN mode liquid crystal with 5 $\mu$m gap and is used as reference data for interpolation. Shown in the second column is starting capacitance, while targeted brightness is shown in the second row, wherein the targeted brightness is set for nine levels of gradation including level 0 (full ON, i.e., black) through level 8 (full OFF, i.e., white). The values shown in the middle of the table are the voltage to be applied. It should be noted that the capacitance is represented in pF/mm$^2$, however, in fact an absolute value of capacitance of the liquid crystal is not necessarily required, instead a relative value of all capacitance $C_{all}$ of a pixel may be used on the basis of minimum capacitance (i.e., OFF) of the liquid crystal.

In FIG. 7, there are shown gradation levels corresponding to the steady state (static state) in the first column and first row, respectively. In general, it is a rare case that the present capacitance corresponds to these gradation levels, so that an actual overdrive voltage may be ordinarily calculated using interpolation, wherein the simple linear interpolation may generate nearly satisfying results. It is seen in the table that there are provided an extra portion in the first column that is described with voltage values ranging from 1.2V to 2.0V, which serves to perform interpolation with a finer precision than nine gradations around the threshold value.

Though there isn't provided a corresponding drawing, capacitance predicting section 12 stores a similar table, which is used to calculate a capacitance value at one frame period later for a pixel with a certain capacitance value. More specifically, it should be shown in this table, for example, that what capacitance value a pixel will reach after 16.7 ms when applying a given voltage to the pixel with a certain capacitance for a gate selection time.

In the embodiment of the present invention, there are provided additional two tables in addition to the above-mentioned tables. One is provided in the change rate Rst calculating section 21 and is used to calculate the effective brightness Yst when overdrive is performed, wherein the change rate Rst is calculated for each of R, G and B from Yst and S and T. The other is provided in the Yst' overdrive voltage calculating section 17 and used to calculate a voltage to be applied based on the effective brightness Yst' which is decelerated for coordination and the present capacitance value or starting brightness S. In either case, an intermediate value is to be calculated by interpolation.

In this manner, according to the invention, for the sub-pixel with the slowest transition (i.e., RstMin), the overdrive voltage is selected from overdrive voltage calculating section 11, while for the other two sub-pixels, the voltage that is accelerated or decelerated for coordination is selected from Yst' overdrive voltage calculating section 17.

Figure 8:
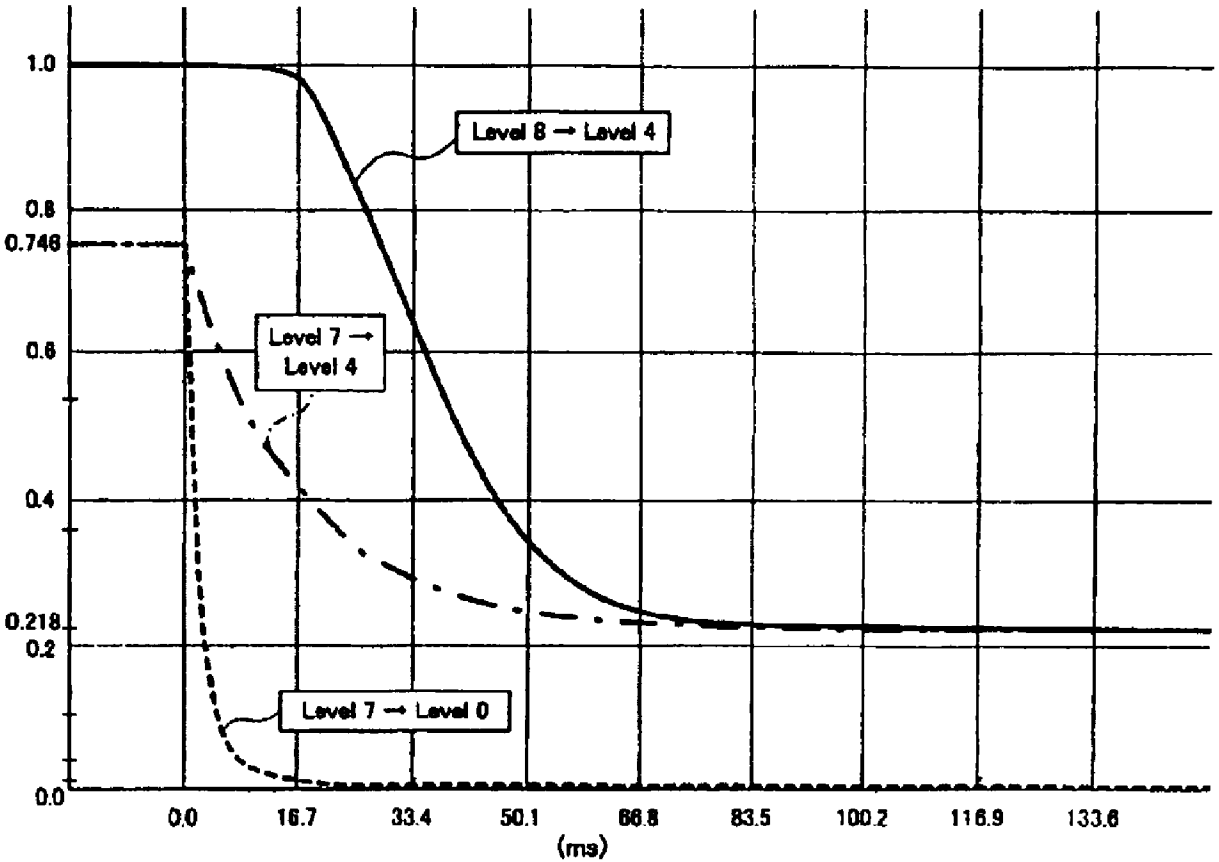
FIG. 8 depicts a transition of brightness for some TN-LC when overdrive is not performed.

FIG. 8 depicts a transition of brightness for some TN-LC when overdrive is not performed. The horizontal axis represents time for transition (ms) while the vertical axis represents a brightness level. On the assumption that y=2.2 and nine gradation levels, level 0 to level 8, are defined, there are shown three transitions: a transition from level 8 (brightness 1.0) to level 4 (brightness 0.22), a transition from level 7 (brightness 0.75) to level 0 (brightness 0.0), and a transition from level 7 (brightness 0.75) to level 4 (brightness 0.22).

FIG. 9 is a table showing the values read from FIG. 8. For example, for the transition from level 8 (brightness 1.0) to level 4 (brightness 0.218), about 4 to 5 frames are required for the response time, where one frame is 16.7 ms. Also, for the transition from level 7 (brightness 0.746) to level 0 (brightness 0.001), about 1 to 2 frames are required for the response time, and for the transition from level 7 (brightness 0.746) to level 4 (brightness 0.218), about 3 to 4 frames are required. Furthermore, effective brightness i to iv represent the frame number during the transition, wherein i corresponds to 0.0 ms to 16.7 ms, ii corresponds to 16.7 ms to 33.4 ms, iii corresponds to 33.4 ms to 50.1 ms, and iv corresponds to 50.1 ms to 66.8 ms. Shown in this table are effective brightness i to iv corresponding to each frame i to iv, wherein the values shown for each of the effective brightness are an integrated value assuming that a rectangular area for each frame is one.

FIG. 10 is a table showing color transitions based on gradation transitions shown in FIG. 9. It is assumed that a gradation transition from level 8 to level 4 corresponds to R (red), the transition from level 7 to level 0 corresponds to G (green), and the transition from level 7 to level 4 corresponds to B (blue). Also assuming that these sub-pixels experience a linear transition, a simple "blur" would occur which proceeds from frame i to frame iv according to the shown colors corresponding to the linear color mixture i to iv. In the table of FIG. 10, it is assumed that the effective brightness of the fourth frame becomes the targeted color, so that R, G and B elements in each frame approach the targeted brightness by 25% per frame, respectively. The values in the table indicates brightness. For the ideal linear color mixture for a gradation transition from white tinged with light pink to deep purple, they should change in order: almost white tinged with purple for linear color mixture i, light purple for linear color mixture ii, slightly deep purple for linear color mixture iii, and deep purple for linear color mixture iv.

However, since the brightness practically takes the values shown in the columns of color shift i through iii, the color shift occurs. The color shift i causes peach color, color shift ii causes purplish red color, and color shift iii causes dark purplish red color. Namely, the same hue is to be maintained for the transition of the linear color mixture, however, the hue practically shifts once towards red for the color shifts. In the embodiment of the invention, since it is presupposed that the color variation at boundaries should be achieved without color shifts, the change rate of effective brightness for each of R, G and B sub-pixels are controlled to match for each pixel, wherein the degree of overdrive is adjusted in order not to cause a change in hue. In this way, the color shift is suppressed and an abnormal appearance at the boundary portion is improved.

As described above, according to the present invention, the change rate of the effective brightness of R, G, and B sub-pixels in a full-pixel is matched by not only acceleration but also deceleration in order to avoid color shifts. Under normal circumstances, overdrive may be preferably applied to all of R, G and B sub-pixels, however, according to the present invention, the degree of overdrive for these two sub-pixels is adjusted to match their change rate of transition to the slowest one in consideration of the following facts:

(a) It is impossible to accelerate a transition to a full OFF state (0 V).

(b) When not allowed using an overvoltage range such as the above 5V range, there may exist a transition which can not be accelerated or is difficult to accelerate in the on-direction.

(c) It is desirable to avoid color shifts even when overdrive is not used.

Consequently, in contrast to the normal non-overdrive case, either of overdrive and underdrive may be performed according to the present invention.

It is noted that in the embodiment of the invention, there is provided overdrive controller 10 between LCD controller 4 and source driver 7, wherein a response time of LCD is improved by overdrive controller 10, however, LCD controller 4 or source driver IC 8 may be responsible for it, or a host system may be responsible for it by performing software. In this case, the system described above may be programmed and installed in a computer on the part of a host system.

As mentioned above, the present invention allows suppressing color shifts which may occur when any area with a sharp boundary moves and improving an abnormal appearance of colors at moving boundary areas.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. A liquid crystal display device, comprising:

a liquid crystal cell forming an image display area;

a driver for applying a voltage to said liquid crystal cell;

an overdrive controller for controlling said driver to apply an overdrive voltage exceeding a targeted pixel value to said liquid crystal cell, wherein said overdrive controller controls such that the driver outputs the voltage to accelerate or decelerate a brightness transition for each sub-pixel in order to make up effective brightness of each sub-pixel which forms a single full-pixel;

wherein said overdrive controller selects the overdrive voltage for the sub-pixel exhibiting the slowest transition of brightness and selects the voltage to accelerate or decelerate a brightness transition for the other sub-pixels in order to coordinate with the sub-pixel exhibiting the slowest transition; and wherein said overdrive controller stores predicted capacitance for each of the sub-pixels and calculates the voltage to accelerate or decelerate a brightness transition for each sub-pixel in order to coordinate with each other based on the predicted capacitance.

2. A liquid crystal display device, comprising:

a liquid crystal cell forming an image display area;

a driver for applying a voltage to said liquid crystal cell;

an overdrive controller for controlling said driver to apply an overdrive voltage exceeding a targeted pixel value to said liquid crystal cell, wherein said overdrive controller controls such that the driver outputs the voltage to accelerate or decelerate a brightness transition for each sub-pixel in order to make up effective brightness of each sub-pixel which forms a single full-pixel; and wherein said overdrive controller stores predicted capacitance for each of the sub-pixels and calculates the overdrive voltage based on the predicted capacitance.

3. A liquid crystal display device, comprising:

a liquid crystal cell for displaying an image when a voltage is applied to each pixel in a thin film transistor (TFT) structure;

a driver for applying a voltage to each of the pixels of said liquid crystal cell;

a controller for controlling the driver to apply a voltage to said liquid crystal cell, the voltage exceeding what is to be applied when displaying targeted brightness on the liquid crystal cell, wherein said controller comprises:

transition state comprehending unit for comprehending for each of the sub-pixels a transition state between present starting brightness of said liquid crystal cell predicted in advance and targeted brightness at one refresh cycle later which is to be displayed hereupon;

voltage calculating unit for calculating a voltage to be applied to each of said sub-pixels based on the transition state comprehended;

capacitance predicting unit for predicting a capacitance value of a pixel that is reached after the refresh cycle when applying said voltage calculated by said voltage calculating unit to the pixel with the present capacitance value; and a storage device for storing said capacitance value predicted by said capacitance predicting unit.

4. The liquid crystal display device according to claim 3, wherein said present starting brightness used by said transition state comprehending unit is said capacitance value stored in said storage device.

5. A liquid crystal display drive circuit comprising:

a capacitance predicting unit for predicting a capacitance value that each pixel reaches at one refresh cycle later when applying a predetermined voltage for targeted brightness;

a storage device for storing the predicted capacitance value;

a transition state comprehending unit for comprehending a transition state of brightness based on the targeted brightness of each sub-pixel at one refresh cycle later and the capacitance value stored in said storage device; and a voltage calculating unit for calculating a voltage to be applied to each sub-pixel based on the transition state of brightness comprehended.

6. The liquid crystal display drive circuit according to claim 5, wherein said voltage calculating unit calculates the voltage which is accelerated or decelerated to coordinate the effective brightness of each sub-pixel.

7. A method for driving a liquid crystal display, wherein an input pixel value is overdriven to output a modified pixel value, the method comprising the steps of:

predicting a capacitance value that each pixel reaches at one refresh cycle later when applying a predetermined voltage for the input pixel value;

storing the predicted capacitance value;

comprehending a transition state of brightness for each of sub-pixels constituting each pixel based on an input pixel value at one refresh cycle later and said stored capacitance value; and calculating a voltage for a predetermined sub-pixel to be underdriven depending on the transition state of brightness comprehended.

8. The method according to claim 7, further comprising the steps of:

selecting the sub-pixel exhibiting the slowest transition of brightness from the transition states comprehended; and calculating a voltage for the selected sub-pixel to be overdriven.

9. A program for directing a computer to drive a liquid crystal display device, the program comprising the functions of:

predicting a capacitance value that each pixel reaches at one refresh cycle later when applying a predetermined voltage to said liquid crystal display device based on a pixel value to be displayed;

storing the predicted capacitance value in a buffer of said computer;

comprehending a transition state of brightness for each of sub-pixels constituting each pixel based on an input pixel value at one refresh cycle later and said stored capacitance value; and calculating a voltage for a predetermined sub-pixel to be underdriven depending on the transition state of brightness comprehended.

* * * * *